US005212940A

United States Patent [19]

Glover

[11] Patent Number: 5,212,940

[45] Date of Patent: May 25, 1993

[54] TIP CLEARANCE CONTROL APPARATUS AND METHOD

[75] Inventor: Jeffrey Glover, Cincinnati, Ohio

[73] Assignee: General Electric Company, Cincinnati, Ohio

[21] Appl. No.: 685,948

[22] Filed: Apr. 16, 1991

[51] Int. Cl.[5] ..... F02C 3/00; F02C 5/00

[52] U.S. Cl. ..... 60/39.02; 60/39.75; 415/115

[58] Field of Search ..... 60/39.02, 39.07, 39.75; 415/115, 116, 173.1, 173.3, 173.6

[56] References Cited

U.S. PATENT DOCUMENTS 2,994,472 8/1961 Botje .
3,742,705 7/1973 Sifford .
4,034,558 7/1977 Korta et al. .
4,466,239 8/1984 Napoli et al. .
4,648,241 3/1987 Putman et al. .
4,704,861 11/1987 Mowill .

*Primary Examiner*—Richard A. Bertsch
*Assistant Examiner*—Howard R. Richman
*Attorney, Agent, or Firm*—Jerome C. Squillaro; John R. Rafter

[57] ABSTRACT

In a gas turbine engine, conduit delivers pressurized cooling air to a selected group of hollow struts at a temperature sufficient to induce thermal contraction of the selected group of hollow struts, thereby opposing a downward shift in the rotor axis during high power engine operation, and maintaining a circumferentially uniform tip clearance. Air baffles disposed in the cooled struts ensure radially uniform thermal contraction and efficient heat transfer.

12 Claims, 4 Drawing Sheets

COLD

HIGH POWER

LOW POWER (PRIOR ART)

TIP CLEARANCE CONTROL APPARATUS AND METHOD

BACKGROUND OF THE INVENTION

Field of the Invention

The present invention relates generally to gas turbine engines and, more specifically, to a clearance control apparatus and method capable of maintaining circumferentially uniform tip clearances for rotating blades.

Description of the Related Art

In a typical aircraft gas turbine engine, a turbine section and a compressor section operate from a common rotor or "spool". The compressor section includes several rows of rotating blades mounted on the rotor, thus constituting the rotor assembly portion of the compressor section, and several rows of stator vanes mounted on a compressor casing, thus constituting a stator assembly portion of the compressor section. Each row of rotating blades and adjacent row of stator vanes is referred to as a "stage" of the compressor section.

The turbine section includes at least one row of rotating blades mounted on the rotor, thus constituting a rotor assembly portion of the turbine section, and at least one row of stator vanes mounted on a stator casing, thus constituting the stator portion of the turbine section.

In a dual rotor-type gas turbine engine such as is illustrated in FIG. 1, which is a schematic view of a General Electric Model CF6-50 aircraft gas turbine engine, a low pressure compressor section 10 and a low pressure turbine section 12 operate from a common rotor 14. A high pressure compressor section 16 and a high pressure turbine section 18 operate from a common rotor 20 which is coaxial with the rotor 14. The turbine sections 12 and 18 are driven by exhaust gases from a combustor 22 and thus drive the compressors 10 and 16, respectively.

The circumferential clearance between the tips of each row of rotating blades of the turbine section, and the corresponding annular surface of the stator portions, such as the stator shrouds, should be kept uniform to achieve optimum engine performance. However, typically for an engine in which the thrust is reacted away from the engine center line, high power conditions cause "backbone bending" of the engine's casings. Backbone bending thus causes the axes of the rotor and stator structures to be non-concentric. In the past, the stator shroud axis has been ground offset relative to the corresponding rotor axis to ensure uniform tip clearances around the circumference at take-off (high power) conditions. As schematically illustrated in FIG. 2(*a*), the offset results in a circular path 24 of the rotating blade tips of a row of turbine blades being eccentric with respect to the corresponding stator shroud surface 26. The amount of offset "o" is the vertical distance between the rotor axis 24*c* and the stator shroud axis 26*c* when the engine is in a cold operating condition (prior to engine start). It should be understood that the amount of offset and the size of the clearance have been exaggerated in FIGS. 2(*a*)–2(*c*) for the sake of illustration.

As shown in FIG. 2(*b*), when the engine is operating under high power conditions, such as at full throttle (take-off), the diameter of the circular path 24 increases due to thermal expansion of the turbine blades, and backbone bending displaces the rotor axis 24*c* downwardly so that the rotor axis becomes substantially coincident with the stator axis 26*c*, thereby creating the desired uniform circumferential clearance $c_1$.

At low power conditions, such as at cruise power, the backbone bending effect is negligible and the offset "o'" reappears as shown in FIG. 2(*c*), thereby creating an undesirably large blade tip clearance $c_2$ on the lower portion of the engine, and a very close clearance $c_3$, (potentially a tip rub) at the top of the engine. The close clearance $c_3$ limits the effectiveness of existing active clearance control (ACC) systems such as those which duct cooling air to the stator shrouds symmetrically around the shroud circumference in order to cause uniform thermal contraction of the stator shroud. While uniform contraction may reduce the clearance of $c_2$, it may also eliminate gap $c_3$ and create an undesirable tip rub.

SUMMARY OF THE INVENTION

An object of the present invention is therefore to provide a tip clearance control apparatus and method for a gas turbine engine capable of producing a circumferentially uniform clearance between rotor and stator components under various operating conditions.

Another object of the present invention is to counteract backbone bending of a rotor without having to grind the stator shroud so as to define a stator shroud axis which is offset from the rotor axis.

These and other objects of the invention are met by providing a tip clearance control apparatus for a gas turbine engine having a turbine section and a compressor section operating from a common rotor having a rotor axis, the compressor section including a compressor rotor assembly portion having plural rows of rotating compressor blades mounted on the common rotor, a compressor stator assembly portion having plural rows of compressor stator vanes mounted on a compressor stator casing, each pair of adjacent rows of rotating compressor blades and compressor stator vanes comprising a compressor stage, the turbine section including a turbine rotor assembly portion having at least one row of rotating turbine blades mounted on the common rotor, each rotating turbine blade having a tip, and a turbine stator assembly portion having at least one row of stator vanes mounted on a turbine stator casing and a stator shroud mounted on the turbine stator casing circumferentially around each row of rotating turbine blades, each stator shroud having a stator shroud axis which is coincident with the rotor axis when the engine is in a cold, no power condition and when the engine is running at a low power condition, the tip clearance being defined as a circumferential space between the rotating turbine blade tips of a given row and an opposing surface of the corresponding turbine stator shroud and being circumferentially uniform during the no power and low power operating conditions, the rotor being positioned relative to the turbine stator assembly portion by bearing means supported by a plurality of struts mounted on a frame, the hollow struts being radially disposed at equidistant intervals around the rotor axis, each strut having a longitudinal axis substantially parallel to the rotor axis, the apparatus including a source of pressurized cooling air having a flow rate proportional to engine power and conduit means for delivering the pressurized cooling air to a selected group of the plurality of hollow struts at a temperature sufficient to induce thermal contraction of the group of hollow struts, thereby opposing a downward shift of the rotor axis during high power engine operation and maintaining the circumferentially uniform tip clearance.

Other features and advantages of the present invention will become more apparent with reference to the following detailed description and drawings.

DETAILED DESCRIPTION OF THE PREFERRED EMBODIMENTS

Figure 1:
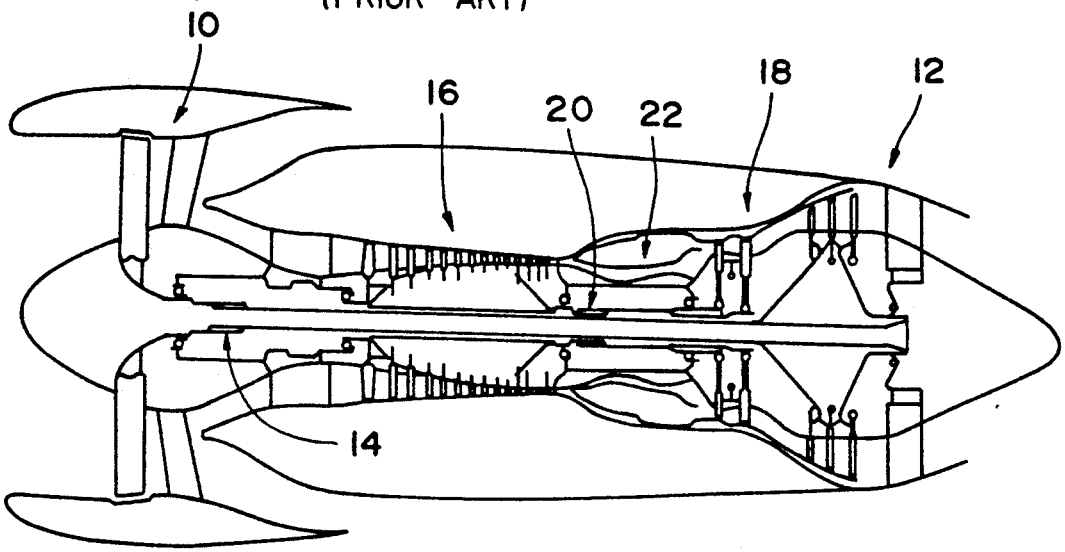
FIG. 1 (PRIOR ART)
FIG. 1 is a schematic view of an aircraft gas turbine engine of known construction.
Figure 2A:
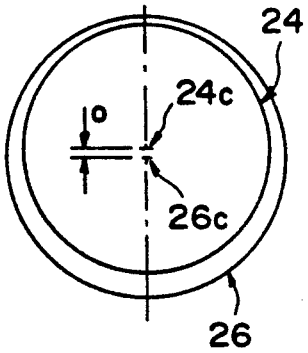
FIGS. 2(*a*), 2(b; and 2(*c*) are schematic views illustrating tip clearances under cold, high power, and low power operating conditions, respectively, and illustrating a known clearance control technique for a gas turbine engine.
Figure 2B:
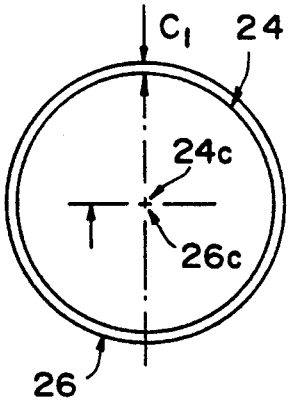
(PRIOR ART) FIG. 2(b)
Figure 2C:
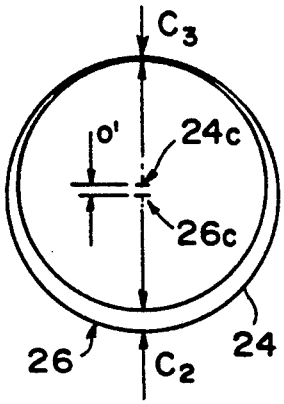
(PRIOR ART) FIG. 2(c)
Figure 3:
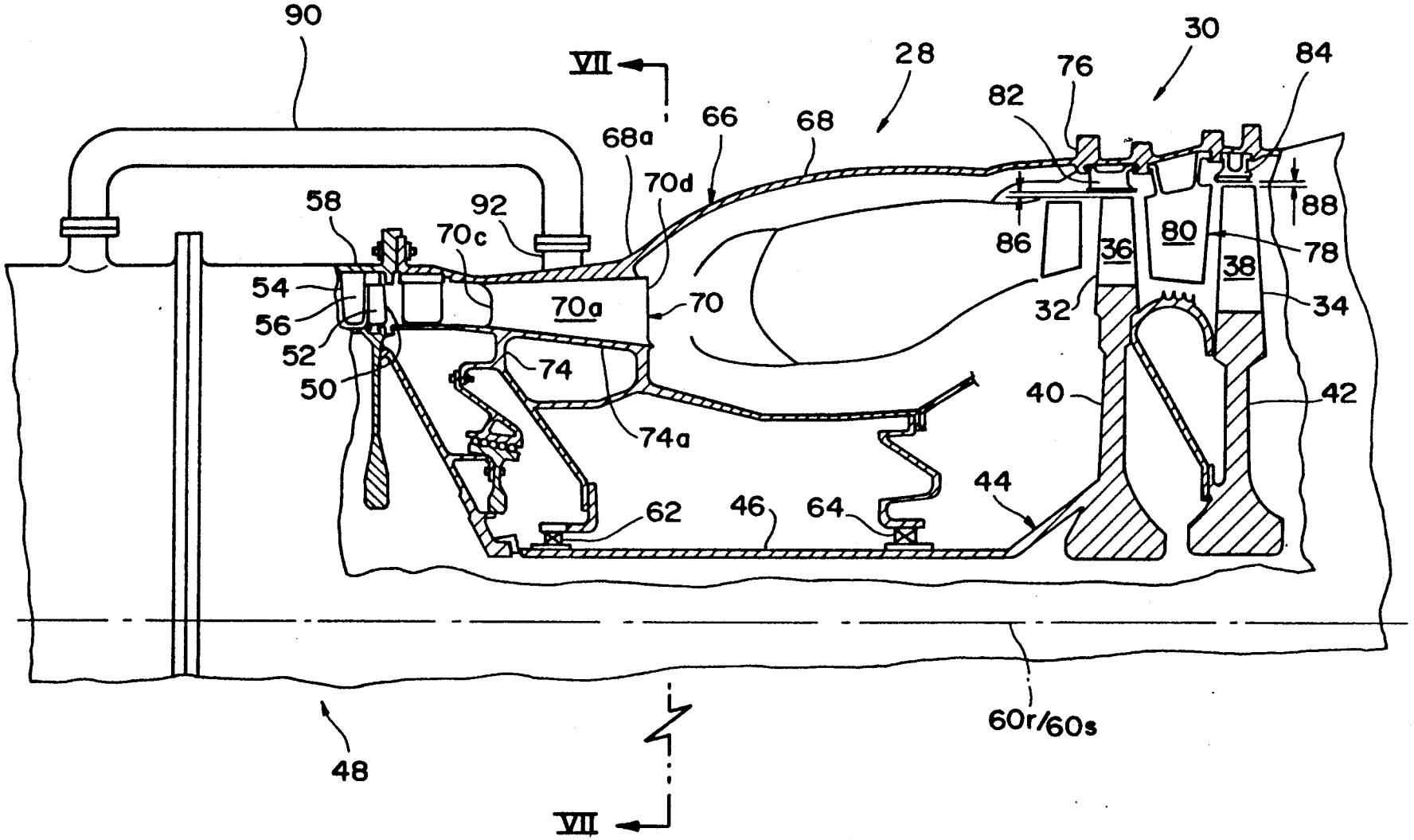
FIG. 3 is an partial longitudinal cross-sectional view of a portion of a gas turbine engine employing the tip clearance control apparatus and method of the present invention taken along line III—III of FIG. 7.

Referring now to FIG. 3, a portion of a gas turbine engine 28 incorporating the apparatus and method of the present invention is illustrated in partial longitudinal cross section. The engine 28 is a General Electric Model CF6-80A/C2, modified to include the tip clearance control apparatus of the present invention, and is similar in construction to the model CF6-50 engine schematically illustrated in FIG. 1, details of construction being deleted in FIG. 3 for clarity. The engine 28 includes a two-stage high pressure turbine section 30 having two rows 32 and 34 of rotating blades 36 and 38, respectively. The rows of blades 32 and 34 are mounted on respective disks 40 and 42, the two disks 40 and 42 constituting part of a rotor 44 which includes a shaft portion 46.

A multi-stage high pressure compressor section 48 includes several rows, such as row 50 of rotating blades 52 mounted on the rotor 44 and several rows, such as row 54, of stator vanes 56 mounted on the stator casing 58.

The rotor 44 has a rotor axis 60*r* and the shaft portion 46 thereof is journalled for rotation by axially displaced rotor bearings 62 and 64 supported and positionally fixed by a frame 66 of the engine. Although the frame 66 is technically the rear frame of the high pressure compressor section 48, it is understood that other frame structures of an engine may support the bearings.

Figure 4:
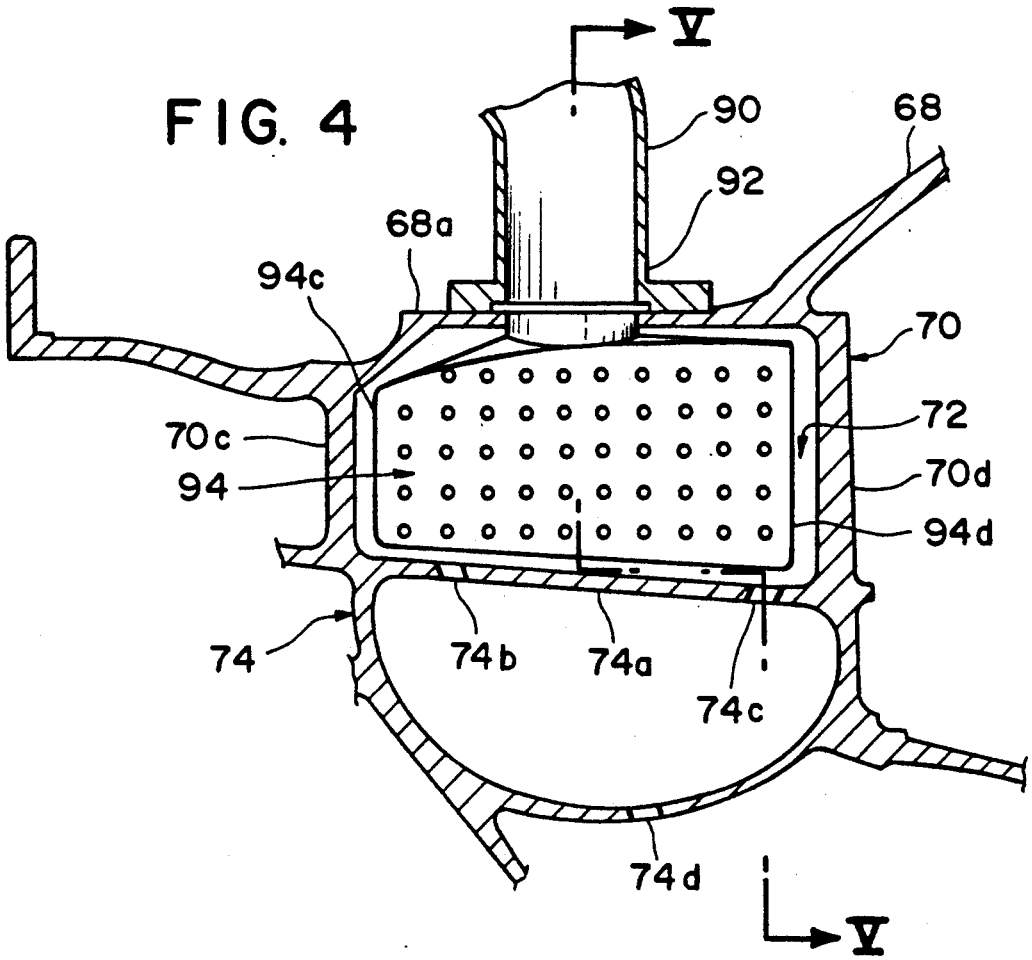
FIG. 4 is an enlarged longitudinal sectional view through one of the plurality of struts of the compressor rear frame of the gas turbine engine of FIG. 3 taken along line IV—IV of FIG. 7.
Figure 5:
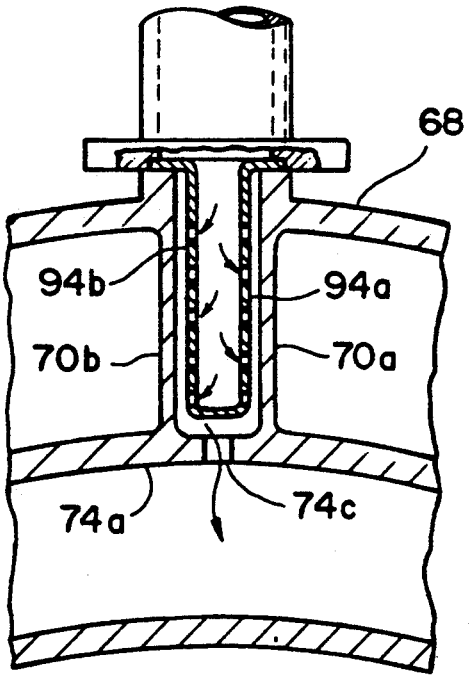
FIG. 5 is a transverse sectional view taken along line V—V of FIG. 4.
Figure 6:
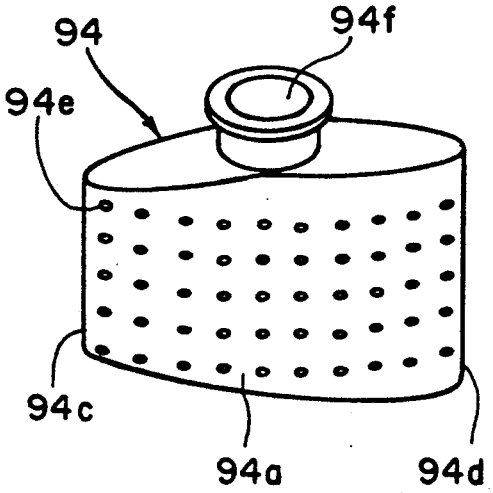
FIG. 6 is a perspective view of an air baffle used in the clearance control apparatus and method of the present invention.
Figure 7:
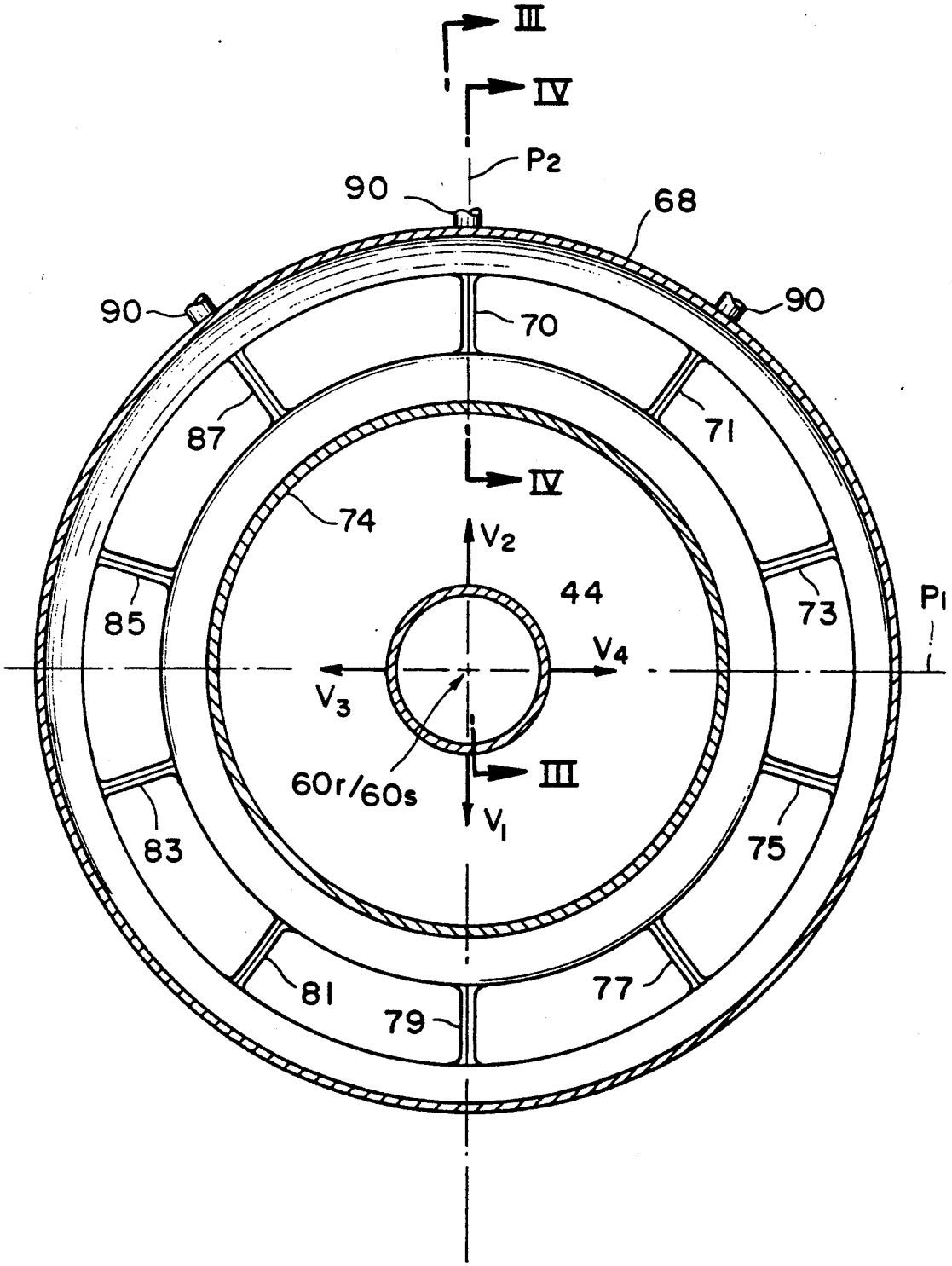
FIG. 7 is a transverse sectional view taken along line VII—VII of FIG. 3 and showing the arrangement of compressor rear frame struts.

The compressor rear frame 66 includes an annular engine casing 68 and a plurality of hollow support struts 70, 71, 73, 75, 77, 79, 81, 83, 85, and 87 (FIG. 7), of which strut 70 is illustrated in FIG. 3. Each strut is integrally formed with the casing 68 and has a longitudinal axis oriented substantially parallel to the rotor axis 60*r*, the respective axes of the plural struts being disposed radially at equiangularly spaced intervals around the rotor axis 60*r*, as shown in FIG. 7. As illustrated in FIGS. 3-5, strut 70 has an airfoil shape with two opposite side walls 70*a* and 70*b* which converge at their respective, opposite axial ends 70*c* and 70*d* to provide leading and trailing edges, respectively. An interior chamber 72 is defined by the side walls 70*a* and 70*b*, a radially outer wall portion 68*a* of the engine casing 68 and a radially inner wall portion 74*a* of a rotor support structure 74.

The high pressure turbine section 30 includes a stator casing 76 to which is mounted a row 78 of stator vanes 80, and two stator shrouds 82 and 84 which are disposed annularly around the tips of the rotating blades 36 and 38, respectively. A first clearance 86 is defined as a space between the tips of the rotating blades 36 and an inner surface of the stator shroud 82, while a second clearance 88 is defined as a space between the tips of the rotating blades 38 and an inner surface of the stator shroud 84.

The stator shroud axes 60*s* for the shrouds 82 and 84 are coincident with the rotor axis 60*r* when the engine is cold and when operating at low power (low r.p.m.s), as shown in FIG. 3. Under high power conditions (high r.p.m.s), backbone bending, if not otherwise compensated for, will result in the rotor axis 60*s* shifting vertically downwardly relatively to the stator shroud axis 60*s* (in the orientation of FIG. 3), thus rendering the circumferential tip clearance non-uniform.

According to the present invention, thermal contraction of a selected group of the radially disposed struts 70, 71, . . . and 87 shifts the location of the rotor axis 60*r* upwardly to compensate for the downward shift attributable to operational conditions such as backbone bending. This is accomplished by introducing cooling air into the hollow interior 72 of the selected group of struts.

Cooling air is bled from one of the stages of the high pressure compressor section 48 and delivered to the selected group of struts through corresponding conduits 90 coupled to the respective inlet ports 92 provided for the struts of the selected group. Heat generated by operation of the engine 28 causes uniform thermal expansion of the plurality of struts. Cooling air introduced into selected ones of the hollow struts causes thermal contraction of the selected struts by heat transfer which results in radial upward shifting of the bearings 62 and 64 and thus of the rotor axis 60*r*. The cooling air exits the struts through exhaust openings 74*b*, 74*c*, and 74*d* provided in the rotor support structure 74.

In order to ensure uniform thermal contraction in the radial direction as well as efficient heat transfer, an air baffle 94 is placed inside each hollow strut of the selected group. Each air baffle is hollow and shaped substantially in the shape of the struts and thus has opposite side walls 94*a* and 94*b* (FIG. 5), which converge at their respective opposite axial ends to form fore and aft edges 94*c* and 94*d*, respectively. The side walls 94*a* and 94*b* oppose the inner surfaces of the strut side walls 70*a* and 70*b*, respectively, and are perforated with openings 94*e* so that cooling air entering a baffle inlet 94*f* is directed against the inner surfaces of the side walls 70*a* and 70*b*. The cooling air discharged from the hollow struts can be vented or re-used for other purposes, such as for sump seal pressurization or turbine component cooling.

To determine which of the struts should be cooled, it should be realized that backbone bending results in a vertically downward shift in the rotor axis 60*r* relative to the stator axis 60*s*. In order to compensate for the shift, the cooled and thus thermally contracted struts should be a group located above a horizontal medial plane $P_1$ of the rotor 44, and preferably symmetrically disposed relative to the vertical medial plane $P_2$, as shown in FIG. 7, so that the direction of force vector $V_1$ (backbone bending) is equal but opposite to the restoring force vector $V_2$ (thermal contraction). It should be expected, however, in practical implementation of the present invention, that net displacement of the rotor axis 60*s* either upwardly or downwardly may occur when the forces are not exactly equal.

Struts 70, 71 and 87 are located above the horizontal medial plane $P_1$ and substantially centered on and/or symmetrical to the vertical medial plane $P_2$. Thermal contraction of struts 70, 71 and 87 produced by the cooling air from the compressor section will shift the rotor axis 60*r* upwardly to counteract a downward shift which occurs under full power conditions. Struts 73 and 85 could also be thermally contracted by use of cooling air, although their contribution to rotor axis shifting would be marginal due to their minimal angular displacement from plane $P_1$.

Other sources of cooling air may be employed, such as air bled from the low pressure compressor discharge (not shown). Thermal expansion of a selected group of struts below the horizontal medial plane $P_1$ achieved by using heated air bled from the combustor or exhaust nozzle (not shown) could be used, as an alternative to, or in combination with thermal contraction to achieve the same results. Moreover, other distortion vectors may be corrected, such as vector $V_3$, so long as the selected group of cooled struts produces a correction vector $V_4$ substantially equal but opposite vector $V_3$ (for example, by cooling at least struts 73 and 75 and possibly 71 and 77 as well). Of course, whichever struts are cooled (or heated) would be provided with appropriate air baffles, inlets, outlets, etc. to communicate cooling (or heating) air therethrough.

Since the flow rate of air from the compressor stages is dependent on engine running speed, the cooling rate is a function of the engine speed unless flow controllers are used. Thus, the present invention can be "passive", simply by having flow rate and thus cooling capacity proportional to engine running speed, or "active" by using flow controllers to modulate flow as needed. Accordingly, flow rate controllers, such as throttle valves disposed in the conduit, with suitable actuators responsive to the engine operating conditions, can be used to adjust the flow rate to achieve the required correction factor. Modification of existing ACC system controllers can be used to position the flow control valves full open at idle and full throttle and to throttle back the cooling air at cruise conditions.

The number of struts (ten) illustrated in FIG. 7 is particular to the General Electric Model CF6-80A/C2 aircraft engine. This engine will have particularly satisfactory results using the present invention due to the bearing configuration in which the rotor bearings determine the position of the rotor axis, and are positionally supported by an arrangement of struts. Other engines having a different number of struts and/or other bearing support structures which are adaptable to thermal contraction or expansion likewise can be adapted to use the tip clearance control apparatus and method of the present invention.

Numerous modifications and adaptations of the present invention will be apparent to those so skilled in the art and thus, it is intended by the following claims to cover all such modifications and adaptations which fall within the true spirit and scope of the invention.

What is claimed is:

1. A tip clearance control method for a gas turbine engine having a turbine section and a compressor section operating from a common rotor having a rotor axis, the compressor section including a compressor rotor assembly portion having plural rows of rotating compressor blades mounted on the common rotor, a compressor stator assembly portion having plural rows of compressor stator vanes mounted on a compressor stator casing, each pair of adjacent rows of rotary compressor blades and compressor stator vanes comprising a compressor stage, the turbine section including a turbine rotor assembly portion having at least one row of rotating turbine blades mounted on the common rotor, each rotating turbine blade having a tip, and a turbine stator assembly portion having at least one row of stator vanes mounted on a turbine stator casing and a stator shroud mounted on the turbine stator casing circumferentially around each row of rotating turbine blades, each stator shroud having a stator shroud axis, the rotor axis being substantially coincident with the stator axis when the engine is in a cold, no power condition and when the engine is running at low power, the tip clearance being defined as a circumferential space between the rotating turbine blade tips of a given row and an opposing surface of the corresponding turbine stator shroud and being circumferentially uniform during no power and low power conditions, the rotor axis being positioned relative to the stator axis by bearing means supported by a plurality of hollow struts mounted on a frame, the hollow struts being radially disposed at equiangular intervals around the rotor axis, each strut having a longitudinal axis substantially parallel to the rotor axis, the method comprising:

tapping a source of pressurized cooling air having a flow rate proportionate to engine power; and delivering the pressurized air through conduit means to a selected group of the hollow struts at a temperature sufficient to induce thermal contraction of the selected group of the hollow struts, thereby opposing a downward shift in the rotor axis during high power engine operation and maintaining a circumferentially uniform tip clearance.

2. A tip clearance control apparatus for a gas turbine engine having a turbine section, a compressor section and a common rotor, the rotor defining a rotor axis extending between and in operative association with each of the turbine and compressor sections, the turbine section including a turbine rotor assembly having at least one row of rotating turbine blades mounted on the common rotor, each rotating turbine blade having a tip, and a turbine stator assembly including a turbine stator casing circumferentially surrounding each row of rotating turbine blades and defining a stator assembly axis, comprising:

bearing means for rotatably supporting the rotor for rotation about the defined rotor axis;

adjustable support means, interconnecting a frame of the gas turbine engine and the bearing means, for supporting the bearing means, the adjustable support means when in thermal equilibrium with the engine and for both the conditions that the engine is in a cold, no power state and the engine is running at low power, normally maintaining the rotor axis in alignment with the stator assembly axis and thereby maintaining a uniform circumferential space, and thus a uniform tip clearance, between the rotating turbine blade tips and the circumferentially surrounding stator casing;

the rotor being subject to a variable displacement force vector of a first predetermined direction and of variable magnitude produced during high power operation of the engine and as a function of the level of the high power, tending to variably displace the rotor axis from the stator assembly axis and correspondingly tending to render the circumferential tip clearance variably non-uniform; and means responsive to the high power level of operation of the engine for selectively producing a differential thermal input to said adjustable support means and said adjustable support means responding to the differential thermal input thereto for producing a variable, compensating force vector of a second, opposite predetermined direction and equal magnitude to the displacement force vector for offsetting the displacement force vector and thereby maintaining the rotor axis in alignment with the stator assembly axis and, correspondingly, maintaining the circumferential tip clearance uniform during high power operation of the engine.

3. A tip clearance control apparatus according to claim 2, wherein the adjustable support means comprises a plurality of hollow struts and the means for producing a differential thermal input comprises:

a source of pressurized cooling air having a flow rate proportional to engine power; and conduit means for delivering the pressurized cooling air to a selected group of the hollow struts at a temperature sufficient to induce thermal contraction of the selected group of the hollow struts, thereby opposing a downward shift in the rotor axis during high power engine operation, and maintaining the circumferentially uniform tip clearance.

4. A tip clearance control apparatus according to claim 3, wherein the group of hollow struts is above a horizontal medial plane of the rotor and centered on a vertical medial plane of the rotor.

5. A tip clearance control apparatus according to claim 4, wherein each hollow strut of the group includes an interior chamber defined by two opposite side walls which converge at opposite axial ends to form a leading edge and a trailing edge, a radially inner wall and a radially outer wall, an inlet port formed in the radially outer wall and an exhaust port formed in the radially inner wall.

6. A tip clearance control apparatus according to claim 5, further comprising an air baffle disposed in each hollow strut of the group and having two perforated side walls which oppose inner surfaces of the two side walls of each corresponding hollow strut and an inlet coupled to the inlet port of each corresponding hollow strut.

7. A tip clearance control apparatus according to claim 3, wherein the source of pressurized air is a selected one several compressor stages, and wherein the conduit means is a pipe leading from the selected compressor stage to each of the hollow struts of the selected group of struts.

8. A tip clearance control method for a gas turbine engine having a turbine section and a compressor section operating from a common rotor having a rotor axis, the compressor section including a compressor rotor assembly portion having plural rows of rotating compressor blades mounted on the common rotor, a compressor stator assembly portion having plural rows of compressor stator vanes mounted on a compressor stator casing, each pair of adjacent rows of rotary compressor blades and compressor stator vanes comprising a compressor stage, the turbine section including a turbine rotor assembly portion having at least one row of rotating turbine blades mounted on the common rotor, each rotating turbine blade having a tip, and a turbine stator assembly portion having at least one row of stator vanes mounted on a turbine stator casing and a stator shroud mounted on the turbine stator casing circumferentially around each row of rotating turbine blades, each stator shroud having a stator shroud axis, the rotor axis being substantially coincident with the stator axis when the engine is in a cold, no power condition and when the engine is running at low power, the tip clearance being defined as a circumferential space between the rotating turbine blade tips of a given row and an opposing surface of the corresponding turbine stator shroud and being circumferentially uniform during no power and low power conditions, the rotor axis being positioned relative to the stator axis by bearing means supported by a plurality of hollow struts mounted on a compressor section rear frame, the hollow struts being radially disposed at equiangular intervals around the rotor axis, each strut having a longitudinal axis substantially parallel to the rotor axis, the apparatus comprising:

a source of pressurized cooling air having a flow rate proportionate to engine power; and conduit means for delivering the pressurized cooling air to a selected group of the hollow struts at a temperature sufficient to induce thermal contraction of the selected group of the hollow struts, thereby opposing a downward shift in the rotor axis during high power engine operation, and maintaining the circumferentially uniform tip clearance.

9. A tip clearance control apparatus according to claim 8, wherein the group of hollow struts is above a horizontal medial plane of the rotor and centered on a vertical medial plane of the rotor.

10. A tip clearance control apparatus according to claim 9, wherein each hollow strut of the group includes an interior chamber defined two opposite side walls which converge at opposite axial ends to form a leading edge and a trailing edge, a radially inner wall and a radially outer wall, an inlet port formed in the radially outer wall and an exhaust port formed in the radially inner wall.

11. A tip clearance control apparatus according to claim 10, further comprising an air baffle disposed in each hollow strut of the group and having two perforated side walls which oppose inner surfaces of the two side walls of each corresponding hollow strut and an inlet coupled to the inlet port of each corresponding hollow strut.

12. A tip clearance control apparatus according to claim 8, wherein the source of pressurized air is a selected one of the compressor stages, and wherein the conduit means is a pipe leading from the selected compressor stage to each of the hollow struts of the selected group of struts.

* * * * *